US008308450B2

(12) United States Patent
Shaull et al.

(10) Patent No.: US 8,308,450 B2
(45) Date of Patent: Nov. 13, 2012

(54) HIGH PRESSURE FUEL PUMP WITH PARALLEL COOLING FUEL FLOW

(75) Inventors: Anthony A. Shaull, Columbus, IN (US); David L. Buchanan, Westport, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 482 days.

(21) Appl. No.: 12/398,570

(22) Filed: Mar. 5, 2009

(65) Prior Publication Data

US 2010/0226795 A1 Sep. 9, 2010

(51) Int. Cl.
*F04B 39/02* (2006.01)
*F04B 39/06* (2006.01)

(52) U.S. Cl. ..... 417/366; 417/372

(58) Field of Classification Search ..... None
See application file for complete search history.

(56) References Cited

U.S. PATENT DOCUMENTS

| | | | | |
|---|---|---|---|---|
| 1,953,809 | A | 4/1934 | Kenneweg | |
| 2,516,692 | A | 7/1950 | French | |
| 2,552,777 | A | 5/1951 | French | |
| 4,462,368 | A | 7/1984 | Funada | |
| 4,924,838 | A | 5/1990 | McCandless | |
| 4,957,085 | A | 9/1990 | Sverdlin | |
| 6,516,784 | B1 | 2/2003 | Shingu | |
| 6,655,366 | B2 | 12/2003 | Sakai | |
| 6,729,307 | B2 | 5/2004 | Dong | |
| 6,823,845 | B2 | 11/2004 | Schueler | |
| 7,021,558 | B2 | 4/2006 | Chenanda et al. | |
| 7,819,107 | B2 * | 10/2010 | Stockner et al. | 123/445 |
| 2004/0052652 | A1 | 3/2004 | Yamada et al. | |
| 2007/0128058 | A1 | 6/2007 | Kitamura | |
| 2007/0283929 | A1 | 12/2007 | Funabashi et al. | |
| 2008/0019853 | A1 | 1/2008 | Hashida et al. | |

FOREIGN PATENT DOCUMENTS

| | | | |
|---|---|---|---|
| DE | 100 39 974 | A1 | 2/2001 |
| EP | 1 323 919 | A2 | 7/2003 |
| JP | 08-261094 | A | 10/1996 |

OTHER PUBLICATIONS

Notification of Transmittal of the International Search Report and the Written Opinion of the International Searching Authority, or the Declaration dated Sep. 28, 2010; International Application No. PCT/US2010/025402.

* cited by examiner

*Primary Examiner* — Anh Mai
*Assistant Examiner* — Britt D Hanley
(74) *Attorney, Agent, or Firm* — Studebaker & Brackett PC; Tim L. Brackett, Jr.

(57) ABSTRACT

A high pressure fuel pump with parallel cooling fuel flow is disclosed wherein a fuel pump barrel having a substantially cylindrical plunger bore with an annular drain groove is provided. A first fuel path is provided that fluidically couples a fuel supply to an annular cooling ring formed on the outer surface of the barrel. The first fuel path further fluidically couples the annular cooling ring to a storage tank via an exit passage. A second, parallel fuel path is provided that fluidically couples the first fuel path to the drain groove, and further includes a drain passage fluidically coupled to the drain groove and the first fuel path via the storage tank.

19 Claims, 2 Drawing Sheets

HIGH PRESSURE FUEL PUMP WITH PARALLEL COOLING FUEL FLOW

BACKGROUND

1. Field of the Invention

The present invention relates generally to high pressure fuel pumps for supplying fuel to internal combustion engines. More particularly, the present invention relates to fuel pump cooling using parallel cooling fuel flow.

2. Description of the Related Art

Today's engine designers must meet the challenge of government mandated emissions criteria while striving to improve engine fuel efficiency. In rising to this challenge, designers create fuel systems that operate at higher pressures than systems of the past. As fuel pressures are increased to excess of 2600 bar, cooling and dilution become problematic with oil lubricated fuel pumps. Further, an increase in pressure leads to an increase in core temperature of the engine combustion area.

Fuel pumps typically include a pump plunger positioned in a bore of a fuel pump barrel and sized so as to permit reciprocating motion within the bore. Pump plungers are driven by a drive system located in a separate mechanical compartment and supplied with lubricating oil. Because the plunger diameter must necessarily be less than the bore diameter, fuel leakage in the resulting space can occur. The clearance gap between pump plunger and barrel is ideally minimized through precision matching of the barrel and plunger to reduce fuel leakage. An increase in barrel temperature, however, causes thermal expansion of the barrel material and therefore necessitates a looser fit between barrel and plunger to permit reciprocating plunger movement at elevated temperature. With a looser plunger/barrel fit, however, fuel is prone to escape from the fuel-pumping chamber and pass along the clearance space between plunger and barrel. This leakage fuel passes into the drive system mechanical compartment and contaminates engine lube oil, thus causing a reduction in oil viscosity and shortening oil life and effectiveness. Accordingly, what is needed is a fuel pump that can provide adequate pressurization to meet modern design standards yet employ a cooling system that effectively maintains fuel pump barrel temperatures for efficient mechanical operations.

SUMMARY

The present invention has been developed to address the above and other problems in the related art. According to some embodiments of the present invention, a high pressure fuel pump with parallel cooling fuel flow is provided that comprises a fuel pump barrel including a bore having first and second ends. The fuel pump barrel includes an annular cooling ring formed on the outer surface of the barrel and annular drain groove positioned within the bore. A first fuel path is provided that comprises a supply passage fluidically coupled to a fuel supply and the annular cooling ring. The first fuel path further comprises an exit passage to direct fuel from the annular cooling ring. A second fuel path is provided that comprises a parallel fuel passage fluidically coupled to the drain groove and the first fuel path to deliver fuel from the first fuel path to the annular drain groove. The second fuel path further comprises a drain passage formed in the barrel and fluidically connected to the annular drain groove to direct fuel flow from the annular drain groove, the second fuel path forming a fuel flow parallel to fuel flow in the first fuel path.

According to other embodiments of the present invention, a method of providing parallel cooling flow within a high pressure fuel pump is provided. The method includes providing a first fuel path including a supply passage, a first intermediate passage extending through a fuel pump barrel adjacent a first end of a bore formed within the fuel pump barrel, and an exit passage. The supply passage, first intermediate passage, and exit passage are all fluidically connected. The method further includes providing a second fuel path including a parallel passage, a second intermediate passage extending through the fuel pump barrel adjacent a second end of the bore, and a drain passage. The parallel passage, second intermediate passage, and drain passage are all fluidically connected. The first and second fuel paths originate from a single supply and terminate to a common drain, thereby forming a parallel cooling fuel flow.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The above and/or other exemplary features and advantages of the preferred embodiments of the present invention will become more apparent through the detailed description of exemplary embodiments thereof with reference to the accompanying drawings, in which.

Throughout the drawings, like reference numbers and labels should be understood to refer to like elements, features, and structures.

DETAILED DESCRIPTION

Exemplary embodiments of the present invention will now be described more fully with reference to the accompanying drawings. The matters exemplified in this description are provided to assist in a comprehensive understanding of various embodiments of the present invention disclosed with reference to the accompanying figures. Accordingly, those of ordinary skill in the art will recognize that various changes and modifications of the embodiments described herein can be made without departing from the scope and spirit of the claimed invention. Descriptions of well-known functions and constructions are omitted for clarity and conciseness. To aid in clarity of description, the terms "upper," "lower," "above," "below," "left" and "right," as used herein, provide reference with respect to orientation of the accompanying drawings and are not meant to be limiting.

Figure 1:
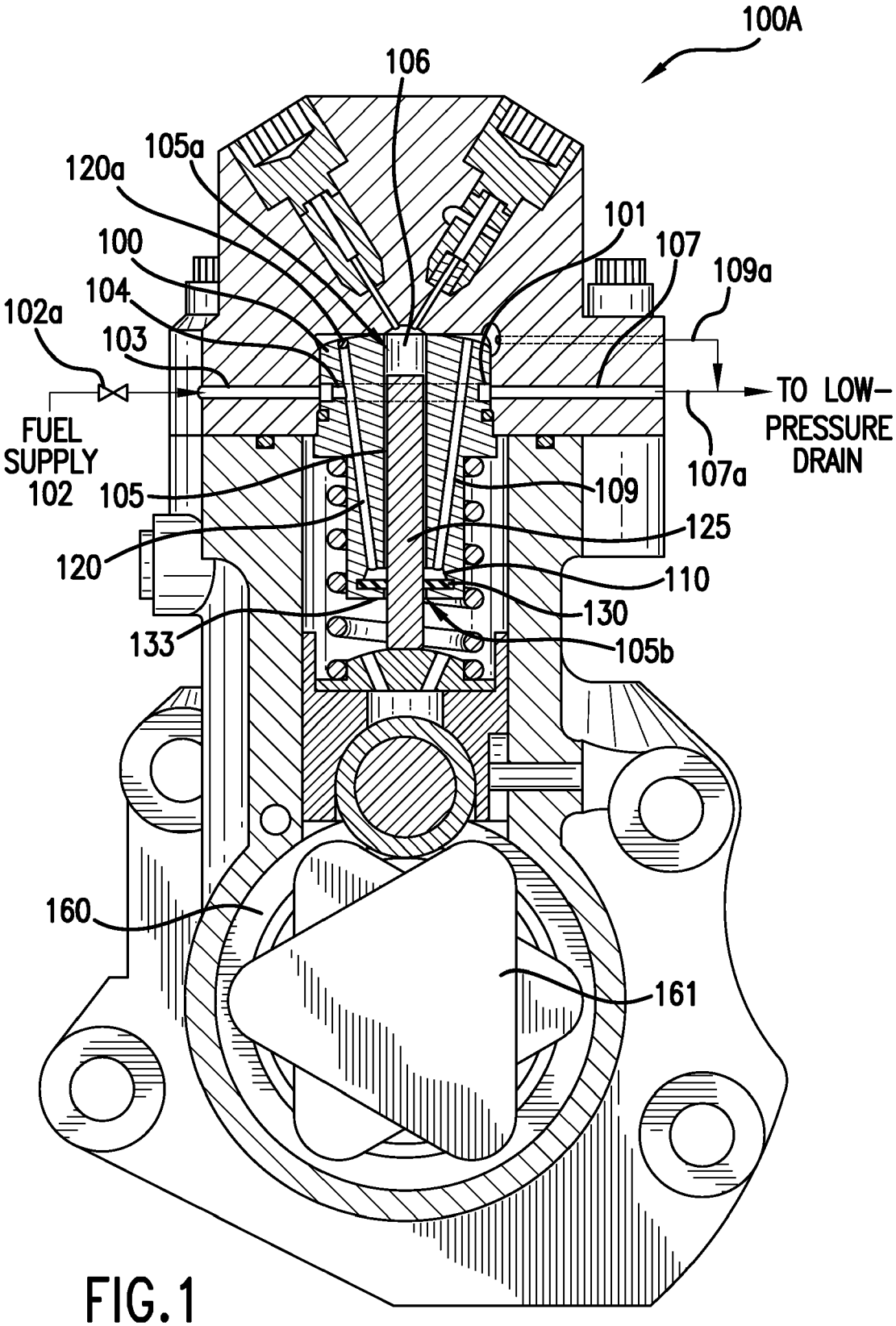
FIG. 1 illustrates a partial cross-sectional view of a fuel pump in accordance with an embodiment of the present invention.

FIG. 1 illustrates a partial cross-sectional view of a fuel pump 100A in accordance with an embodiment of the present invention. As will be described in detail below, a novel manner of cooling a fuel pump barrel that is capable of maintaining high pressures in a fuel pump is disclosed. The novel cooling of the present invention enhances fuel pump durability and reliability as compared to conventional fuel pumps.

Referring to FIG. 1, a fuel pump barrel 100 forms a substantially cylindrical bore 105 having a first end 105*a* and a second end 105*b* separated by a length of bore. First end 105*a* is substantially closed whereas second end 105*b* is open to permit insertion of plunger 125. That is, bore 105 forms an opening in barrel 100 at second end 105*b*. The fuel pump barrel 100 and associated components may be constructed of any material that can withstand the pressures and heat of fluids processed therethrough. For example, heat treated steel or aluminum are suitable materials. Towards first end 105*a* of bore 105, an annular cooling groove or ring 101 is formed on an outer surface of barrel 100, encircling bore 105, to receive cooling fuel from a fuel supply 102. Towards second end 105*b* of bore 105, an annular drain groove 110 is formed in fuel pump barrel 100 that spans the circumference of and encircles the bore.

Cooling fuel enters fuel pump barrel 100 via fuel supply 102. In an exemplary embodiment, cooling fuel is obtained from a low pressure supply, such as, for example, a preceding fuel pump or extracted from the downstream side of a low pressure pump (not shown), such as a fuel gear pump. In a first fuel path, fuel supply 102 is fluidically coupled to supply passage 103, which is fluidically coupled to annular cooling ring 101. Thus, annular cooling ring 101 forms a portion of the first fuel path extending through the barrel. Also fluidically coupled to annular cooling ring 101 is exit passage 107, which directs fuel from the annular cooling ring and is fluidically coupled to a fuel storage vessel (not shown). In an exemplary embodiment, exit passage 107 is fluidically coupled to a terminal series fuel circuit 107*a* that terminates at a fuel storage vessel (not shown). In an exemplary embodiment, the terminal fuel circuit comprises a low pressure drain. Supply passage 103, annular cooling ring 101, and exit passage 107 comprise the first fuel path, forming a substantially series fuel flow.

A second fuel path is provided, comprising parallel fuel passage 120, which is fluidically coupled to the first fuel path and annular drain groove 110 to deliver fuel from the first fuel path to the drain groove. In the exemplary embodiment shown in FIG. 1, parallel fuel passage 120 is fluidically connected to the first fuel path via a transfer passage 104. In an exemplary embodiment, parallel fuel passage 120 is fluidically coupled to the first fuel path at supply fuel passage 103. In an exemplary embodiment, parallel fuel passage 120 is fluidically coupled to the first fuel path at annular cooling ring 101. Parallel fuel passage 120 is capped with plug 120*a*. The second fuel path also comprises drain passage 109, which is fluidically connected to drain groove 110, to direct fuel flow from the drain groove to low pressure drain. In exemplary embodiments, the drain passage 109 is fluidically connected to a fuel storage vessel (not shown). Parallel fuel passage 120, annular drain groove 110, and drain passage 109 comprise the second fuel path, forming a substantially parallel fuel flow. In exemplary embodiments, the second fuel path is fluidically coupled to a terminal parallel fuel circuit 109*a* terminating at a fuel storage vessel (not shown), and drain passage 109 is fluidically coupled to the first fuel path via the storage vessel. As used herein throughout, parallel refers to the diverting or splitting of a single fuel flow into two flow paths. Exemplary embodiments provide for the flow paths to fluidically couple at some point after splitting. Such a coupling is not, however, essential for the substantially parallel nature of the flows to exist.

In operation, cooling fuel enters fuel pump 100A via fuel supply 102. Fuel passes through supply passage 103 to enter annular cooling ring 101. Cooling fuel flow passes along the outer diameter of barrel 100 while circulating through annular cooling ring 101, which serves to reduce the temperature of barrel 100. Because annular cooling ring 101 encircles bore 105, annular cooling ring 101 comprises two semi-circular passages, each on opposite sides of bore 105. As fuel flow reaches annular cooling ring 101, some fuel molecules flow through one semi-circle, and other fuel molecules flow through the other semi-circle. Thus, fuel diverts and flows through both semi-circular passages, forming a parallel fuel flow on either side of bore 105. Cooling fuel exits annular cooling ring 101 via exit passage 107, then continues to a low pressure drain, such as a fuel storage vessel. In an exemplary embodiment, a control valve 102*a* can be added to the cooling fuel circuit and fluidically couple to the first fuel path to temporarily block cooling fuel flow during engine cranking. In an exemplary embodiment control valve 102*a* is a 32 psi control valve to permit cooling fuel flow when the pressure rises to 32 psi.

While fuel traverses through the first fuel path as described above, some fuel molecules divert to parallel fuel passage 120. Parallel fuel passage 120 can fluidically couple the first fuel path via transfer passage 104. Cooling fuel travels down parallel fuel passage 120 and enters annular drain groove 110 where it mixes with leakage fuel, having the effect of cooling the leakage fuel (described below). The fuel mixture then exits annular drain groove 110 via drain passage 109, where it flows to low pressure drain, such as the fuel storage vessel. An exemplary embodiment provides for drain passage 109 to fluidically couple with the first fuel path via the fuel storage vessel.

In an independent, alternate embodiment, the inventive feature of providing cooling flow through an outer groove in the fuel pump barrel may be employed without a second fuel path to also achieve the benefit of barrel cooling. Such an embodiment encompasses the serial fuel flow path of the combined parallel cooling fuel flow described above but omits the parallel fuel flow structure. Although FIG. 1 provides disclosure for a combined serial/parallel cooling fuel flow embodiment, FIG. 1 may also serve to support this independent, alternate embodiment directed to serial cooling fuel flow. Thus, cooling fuel enters fuel pump barrel 100 via fuel supply 102. In an exemplary embodiment, cooling fuel is obtained from a low pressure supply, such as, for example, a preceding fuel pump or extracted from the downstream side of a low pressure pump (not shown), such as a fuel gear pump. In a first fuel path, fuel supply 102 is fluidically coupled to a supply passage 103, which is fluidically coupled to annular cooling ring 101. Also fluidically coupled to annular cooling ring 101 is exit passage 107, which directs fuel from the annular cooling ring and is fluidically coupled to a fuel storage vessel. In an exemplary embodiment, exit passage 107 directs fuel from the annular cooling ring via low pressure drain. In an exemplary embodiment, exit passage 107 is fluidically coupled to a terminal fuel circuit 107*a* that terminates at a fuel storage vessel (not shown). Supply passage 103, annular cooling ring 101, and exit passage 107 comprise the serial fuel path, forming a substantially series fuel flow.

Exemplary embodiments of the present invention provide a method of parallel cooling flow within the high pressure fuel pump. The first step of the method includes providing a first fuel path, including a supply passage, a first intermediate passage that extends through the fuel pump barrel adjacent a first end of a bore formed within the fuel pump barrel, and an exit passage. The supply passage, first intermediate passage, and exit passage are all fluidically connected and provide a pathway for cooling fuel to pass through the top end of the fuel pump barrel. The method further includes providing a second fuel path, including a parallel passage, a second intermediate passage extending through the fuel pump barrel adjacent a second end of the bore, and a drain passage. The parallel passage, second intermediate passage, and drain passage are all fluidically connected and provide a pathway for cooling fuel to pass through the lower end of the fuel pump barrel. The second fuel path runs substantially parallel to the first fuel path. The first and second fuel paths originate from a single supply and terminate to a common drain, thereby forming a parallel cooling fuel flow. In an exemplary embodiment the second fuel path is fluidically connected to the first fuel path via a transfer passage and the common drain comprises a fuel storage vessel. In an exemplary embodiment the first intermediate passage includes an annular cooling ring or groove. The annular cooling ring or groove is formed on an outer surface of the barrel, in the upper portion of and encircling the bore, to receive cooling fuel from a fuel supply. In an exemplary embodiment the second intermediate passage includes a drain ring or groove. The annular drain groove is formed in fuel pump barrel near the lower portion of the bore, spanning the circumference of and encircling the bore.

A reciprocating plunger 125 is mounted in bore 105 for reciprocal movement through compression and retraction strokes. Plunger 125 has an outer diameter that is slightly less than the inner diameter of bore 105 to form an annular clearance that permits reciprocating movement of the plunger within the bore while creating a partial fluid seal to permit pressurization of pumping chamber 106 during the compression stroke, thereby forming a seal length along the plunger between the plunger and bore. Plunger 125 extends through the bore opening near second end 105*b* and into bore 105. The top end of plunger 125 within bore 105 serves to provide a boundary for fuel pumping chamber 106. Plunger 125 is driven by a drive system 161, such as a rotating cam and tappet assembly, located in a separate mechanical compartment 160 containing lubricating oil, such as disclosed in U.S. Pat. Nos. 5,775,203 and 5,983,863, each of which is hereby incorporated by reference in their entirety.

An annular seal 130 is provided for sealing plunger 125 within bore 105. Seal 130 abuts groove 110 and is located substantially at second end 105*b* of bore 105. In this position, seal 130 provides separation of fuel within the fuel pumping chamber 106 of bore 105 and space above groove 110 from lube oil within the mechanical compartment 160 containing drive system 161. Seal 130 can be made from any material known to those of ordinary skill in the art that is suitable for sealing in accordance with the present invention. In exemplary embodiments, seal 130 comprises PTFE-based materials with metal springs to energize the seal. Fluoroelastomers, such as Viton®, can be used. Other embodiments employ metallic seals or seals comprising magnetic fluids (ferrofluids). Preferably, drain groove 110 and seal 130 are positioned immediately adjacent one another so that the upper face of seal 130 forms the lower wall of drain groove 110. In this exemplary embodiment, no portion of fuel pump barrel 100 extends between seal 130 and drain groove 110 to create a bore seal length. In an exemplary embodiment, the lower portion of the seal length opens into the seal.

Seal 130 is secured by seal support 133, which provides structure, such as a lip or ledge, upon which seal 130 is supported. Seal support 133 can be a plate that extends across the lower portion of the barrel and is secured to the barrel by a fastening mechanism as would be known to those of ordinary skill in the art. Seal support 133 can be positioned between seal 130 and the bore opening and establishes bore second end 105*b*. In an exemplary embodiment, seal support 133 is an integral portion of barrel 100 and is formed to retain seal 130 in position abutting drain groove 110. Alternatively, seal support 133 is a separate component, for example, a plate that extends across the lower portion of barrel 100, connected to barrel 100 by any means available to those of ordinary skill in the art, such as any conventional fastener or connector device, threading or compression fitting. Seal 130 may be coupled to support 133 to form a compound unit. In an exemplary embodiment, seal support 133 is annular and has an inner diameter equivalent to the inner diameter of bore 105. In alternate embodiments the inner diameter of seal support 133 can be larger or smaller than the inner diameter of bore 105. In an exemplary embodiment, seal support 133 is formed of just enough material to support seal 130. In an alternate embodiment, a separate element provides the seal support function and couples to bore 105 to support seal 130 and retain its position abutting drain groove 110.

During the compression stroke, plunger 125, operating above seal 130, is reciprocated deeper into bore 105 and the pressure and temperature within pumping chamber 106 increases. In this state, pressurized fuel in chamber 106 can flow or leak through the clearance between plunger 125 and bore 105. Additionally, because of the elevated temperature and pressure, fuel can vaporize, thus becoming susceptible to leaking through the clearance space. Leaking fuel vapor and fluid is captured by drain groove 110 for evacuation through parallel fuel passage 120. Because groove 110 and seal 130 are positioned substantially at second end 105*b* of bore 105, separated from the bore opening by seal support 133, the entire length of bore 105 from pumping chamber 106 to groove 110 can be devoted to high pressure sealing. That is, the entire length of bore 105 from pumping chamber 106 to groove 110 forms a high pressure seal length. Fuel pressure, which is highest in pumping chamber 106, decreases along the bore seal length from chamber 106 to drain groove 110 as leakage fuel and vapor travel down the clearance between plunger 125 and bore 105, thus providing a decreasing or negative pressure gradient. The fuel pressure in drain groove 110 is maintained at a low pressure level, that is, for example, drain pressure of 0-100 PSI, since fluid and vapor can escape from drain groove 110 into drain passage 109. In conventional fuel pumps, a non-pressurized bore length below the drainage groove is employed to separate the groove from lube oil. This requires, however, a larger clearance between plunger and bore in order to allow for plunger dilation during Poisson expansion of the plunger while under axial load, which causes pressure spikes during each pumping stroke. Such a larger clearance can permit fuel leakage into the lube oil and the pressure spikes stress the sealing system, thereby shortening its lifecycle. Thus, a smaller clearance, that is, a match fit, between plunger 125 and bore 105, along the length of bore 105 above the drain groove 110, can be used since the non-pressurized bore length below drain groove 110 is substantially eliminated. For example, traditional fuel pumps require a clearance of 5 microns but exemplary embodiments of the present invention, however, can employ a clearance of approximately 3 microns. By using seal 130 instead of a portion of plunger bore 105 to provide sealing, the entire length of plunger bore 105, that is, the seal length, can be devoted to efficient pumping due to pressurized sealing because it is free from another seal or drain passage that intervenes along its length. Thus, seal 130 has only to separate fuel from lube oil at low pressure. Therefore, the sealing and pumping functions are separated, and fuel dilution and contamination from leaking lube oil, and oil dilution and contamination from leaking fuel and vapor, is minimized. Also, the removal of the fuel vapor by drain groove 110 and the second fuel path, including drain passage 109, helps prevent heat build-up thereby further advantageously reducing fuel-to-oil transfer and cavitation issues.

The dedicated high pressure seal length in accordance with embodiments of the present invention provides an unexpected benefit to high pressure pumping efficiency and permits use of a flexible seal as seal 130. Additionally, because of the improvement in pumping efficiency, the length of the bore itself can be made shorter and have less form error (because of the shorter length and absence of a groove to interrupt machining), which in turn can lead to smaller engine size for a given power output. For example, traditional fuel pumps require a bore length of 47 mm with a seal length of 24 mm. Exemplary embodiments of the present invention, however, employ a bore length of approximately 36 mm with a seal length that is the same, that is, approximately 36 mm.

Preferably, the high pressure seal length is free from drain grooves, drain or cooling flow passages, or any other obstruction. Accordingly, the portion of plunger 125 that reciprocates between drain groove 110 and pumping chamber 106 is free from annular grooves and obstructions, and likewise the corresponding surface of bore 105 is free from annular grooves and obstructions to create a complimentary fit. In an alternate embodiment, however, a collection groove (not shown) can be provided to capture fuel. Such a groove can aid in lubrication during reciprocation of plunger 125. In an exemplary embodiment, a fuel collection groove is fluidically coupled to a fuel flow passage.

In operation, fuel is supplied to the pumping chamber 106. During the compression stroke of plunger 125, reciprocating deeper into bore 105, the pressure and temperature of the fuel within pumping chamber 106 increases. A seal length is formed within the annular clearance between plunger 125 and bore 105. A small quantity of fuel, however, will escape pumping chamber 106 and the seal length. This leakage fuel, which can be partially vaporized, is collected at drain groove 110 and prevented from entering mechanical compartment 160 by seal 130. The leakage fuel, both liquid and vapor, is evacuated from drain groove 110 through drain passage 109. Exemplary embodiments provide cooling fuel to drain grove 110 to aid in fuel liquification and evacuation through drain passage 109. Drain passage 109 may be coupled to a fuel drain circuit that terminates at a fuel storage vessel to facilitate fuel recycling within the fueling system.

A parallel fuel passage 120 is provided within fuel pump barrel 100 to direct or deliver cooling fuel flow to drain groove 110. Parallel fuel passage 120 transports cooling fuel to reduce thermal heating due to high pressure pumping, which in turn reduces thermal expansion. The cooling fuel is preferably supplied from low pressure supply fuel, for example, extracted from the downstream side of a low pressure pump (not shown) that supplies fuel to the fuel pump for delivery to the pumping chamber 106.

Drain groove 110 collects fuel leakage passing through the clearance between plunger 125 and bore 105 during pumping. Because of the elevated temperature and pressure in pumping chamber 106, fuel can vaporize. Thus, the leakage fuel can be a mix of liquid and vapor. When the cooling fuel mixes with the leakage fuel in drain groove 110, the cooling effect of the cooling fuel can cause the leaking fuel to be maintained in the liquid state, which can be less harsh on seal 130 and plunger 125, and/or transformed back into a liquid state which, in turn, assists in reducing leakage out of the bottom of the barrel into the lube oil system. Fuel within drain groove 110 is evacuated through drain passage 109 for return to a fuel storage vessel (not shown). A novel manner of sealing a reciprocating plunger that is capable of maintaining high pressures in a fuel pump is disclosed in copending U.S. patent application Ser. No. 12/195,550, filed Aug. 21, 2008, which is hereby incorporated by reference in its entirety.

Figure 2:
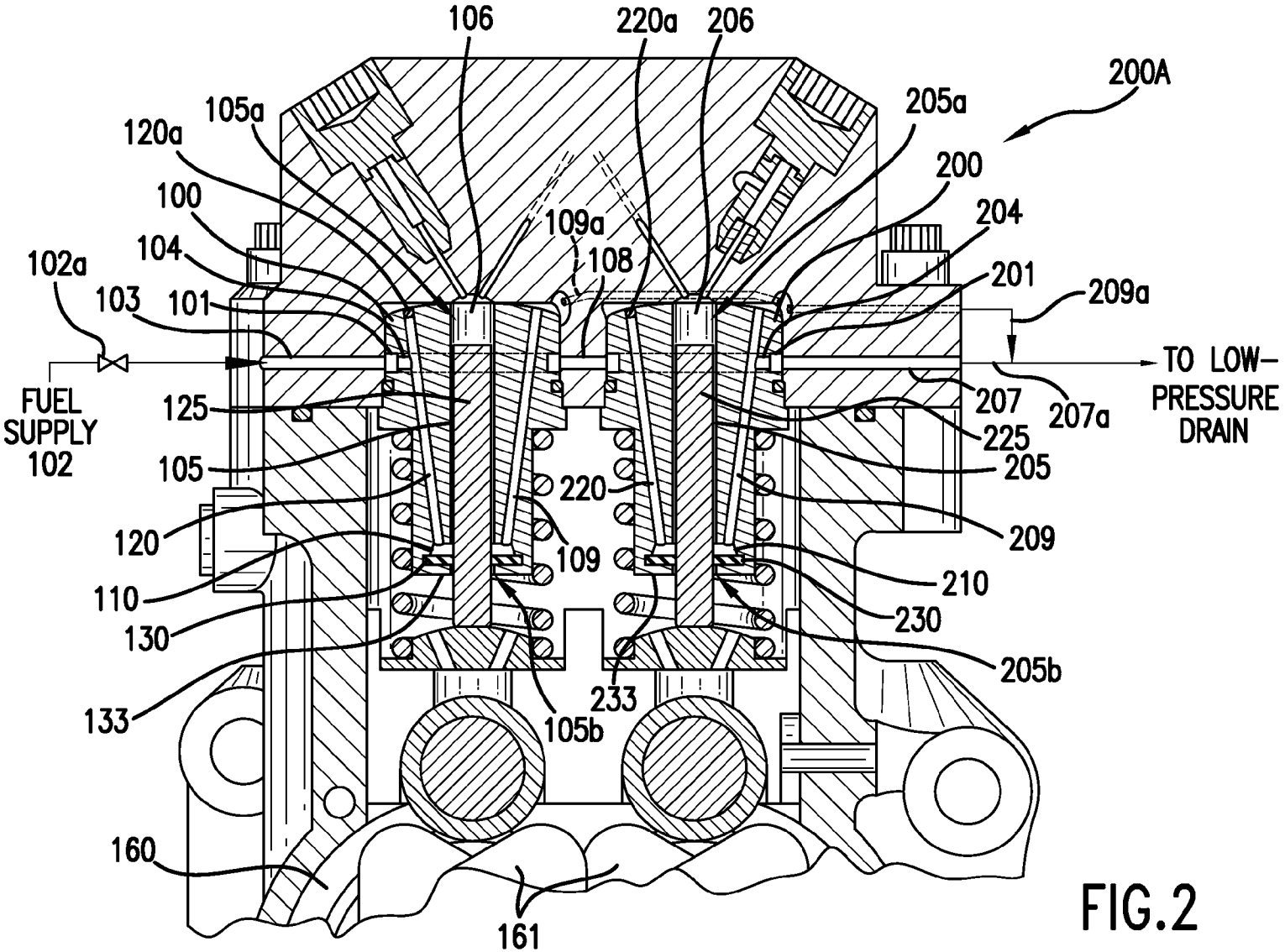
FIG. 2 illustrates a partial cross-sectional view of a fuel pump in accordance with an embodiment of the present invention.

FIG. 2 illustrates a partial cross-sectional view of a fuel pump in accordance with an embodiment of the present invention. In the embodiment of FIG. 2, two fuel pump barrels of a fuel pump 200A are shown and the description herein will be directed to that quantity. Other embodiments of the invention, however, provide for a plurality of fuel pump barrels in excess of two. The description of such a plurality will be omitted for clarity and conciseness since the understanding of such embodiments is within the grasp of one of ordinary skill in the art in view the present disclosure. Referring to FIG. 2, fuel pump barrels 100, 200 form substantially cylindrical bores 105, 205 having first ends 105*a*, 205*a* and second ends 105*b*, 205*b*, respectively, each first and second end being separated by a length of bore. First ends 105*a*, 205*a* are substantially closed whereas second ends 105*b*, 205*b* are open to permit insertion of respective plungers 125, 225. That is, bore 105 forms an opening in barrel 100 at second end 105*b*, and bore 205 forms an opening in barrel 200 at second end 205*b*. The fuel pump barrels 100, 200 and associated components may be constructed of any material that can withstand the pressures and heat of fluids processed therethrough. For example, heat treated steel or aluminum are suitable materials. Towards first end 105*a* of bore 105, an annular cooling ring 101 is formed on an outer surface of barrel 100, encircling bore 105, to receive cooling fuel from fuel supply 102. Towards second end 105*b* of bore 105, an annular drain groove 110 is formed in fuel pump barrel 100 that spans the circumference of and encircles the bore. Similarly, towards first end 205*a* of bore 205, an annular cooling ring 201 is formed on an outer surface of barrel 200, encircling bore 205, to receive cooling fuel from fuel supply 102 via pump barrel 100. Towards second end 205*b* of bore 205, an annular drain groove 210 is formed in fuel pump barrel 200 that spans the circumference of and encircles the bore.

Cooling fuel enters fuel pump 200A via fuel supply 102. In an exemplary embodiment, cooling fuel is obtained from a low pressure supply, such as, for example, a preceding fuel pump or extracted from the downstream side of a low pressure pump (not shown), such as a fuel gear pump. In a first fuel path, fuel supply 102 is fluidically coupled to supply passage 103, which is fluidically coupled to annular cooling ring 101. Also fluidically coupled to annular cooling ring 101 is exit passage 107, which directs fuel from the annular cooling ring and is fluidically coupled to a fuel storage vessel (not shown) via fuel pump barrel 200. Exit passage 107 is fluidically coupled to fuel pump barrel 200 via connector passage 108 and terminal supply passage 204. In embodiments comprising additional fuel pump barrels, additional connector passages fluidically couple successive adjacent annular cooling rings of successive adjacent fuel pump barrels. The first fuel path further comprises terminal exit passage 207 that is fluidically coupled to the annular cooling ring 201 of fuel pump barrel 200. In an exemplary embodiment, terminal exit passage 207 is fluidically coupled to a terminal series fuel circuit 207*a* that terminates at a fuel storage vessel (not shown). In an exemplary embodiment, the terminal series fuel circuit comprises a low pressure drain. Supply passage 103, annular cooling ring 101, exit passage 107, the one or more connector passages and respective annular cooling rings, terminal supply passage 204, annular cooling ring 201, and terminal exit passage 207 comprise the first fuel path, forming a substantially series fuel flow.

A second fuel path is provided, comprising parallel fuel passage 120, which is fluidically coupled to the first fuel path and annular drain groove 110 to deliver fuel from the first fuel path to the drain groove. In exemplary embodiments, parallel fuel passage 120 is fluidically coupled to the first fuel path at the supply fuel passage. Other embodiments provide the parallel fuel passage 120 being fluidically coupled to the first fuel path at the annular cooling ring. In the exemplary embodiment shown in FIG. 2, parallel fuel passage 120 couples with the first fuel path via transfer passage 104. Parallel fuel passage 120 is capped with plug 120*a*. The second fuel path also comprises drain passage 109, which is fluidically coupled to drain groove 110 to direct fuel flow from the drain groove. In exemplary embodiments, drain passage 109 is fluidically connected to a low pressure drain, such as, for example, a fuel storage vessel (not shown). In embodiments comprising additional fuel pump barrels, the second fuel path further comprises intermediate parallel fuel passages that fluidically couple the drain groove of a respective intermediate fuel pump barrel and the first fuel path.

In embodiments comprising additional fuel pump barrels, the second fuel path further comprises an intermediate parallel drain passage that is fluidically coupled to the drain groove of a respective intermediate fuel pump barrel. With respect to FIG. 2, the second fuel path further comprises a terminal parallel fuel passage 220 that is fluidically connected to drain groove 210 and the first fuel path. Terminal parallel fuel passage 220 is capped with plug 220*a*. The second fuel path further comprises a terminal drain passage 209 that is fluidically connected to drain groove 210 to direct fuel flow from the drain groove to low pressure drain. In exemplary embodiments, drain passage 209 is fluidically connected to a fuel storage vessel (not shown) via a second terminal parallel fuel circuit 209*a*. Parallel fuel passage 120, annular drain groove 110, drain passage 109, terminal parallel fuel passage 220, drain groove 210, and terminal drain passage 209 comprise the second fuel path, forming a substantially parallel fuel flow. In an exemplary embodiment, drain passages 109 and 209 are fluidically connected to form a drain path parallel to the first fuel path.

In operation, cooling fuel enters fuel pump 200A via fuel supply 102. Fuel passes through supply passage 103 to enter annular cooling ring 101. Cooling fuel flow passes along the outer diameter of barrel 100 while circulating through annular cooling ring 101, which serves to reduce the temperature of barrel 100 and thereby reduce thermal growth during high pressure pumping. Because annular cooling ring 101 encircles bore 105, annular cooling ring 101 comprises two semi-circular passages, each on opposite sides of bore 105. As fuel flow reaches annular cooling ring 101, some fuel molecules flow through one semi-circle, and other fuel molecules flow through the other semi-circle. Thus, fuel diverts and flows through both semi-circular passages, forming a parallel fuel flow on either side of bore 105. Cooling fuel exits annular cooling ring 101 via connector passage 108, then enters pump barrel 200 via terminal supply passage 204, continuing to annular cooling ring 201. Cooling fuel flow passes along the outer diameter of barrel 200 while circulating through annular cooling ring 201, which serves to reduce the temperature of barrel 200 and thereby reduce thermal growth during high pressure pumping. As with bore 105, annular cooling ring 201 encircles bore 205. Thus, fuel diverts and flows through both semi-circular passages of annular cooling ring 201, forming a parallel fuel flow on either side of bore 205. Cooling fuel exits annular cooling ring 201 via terminal exit passage 207 to low pressure drain. In exemplary embodiments, fuel travels through terminal exit passage 207 to a fuel storage vessel via a terminal series fuel circuit 207*a*. In an exemplary embodiment, a control valve 102*a* can be added to the cooling fuel circuit and fluidically couple to the first fuel path to temporarily block cooling fuel flow during engine cranking. In an exemplary embodiment control valve 102*a* is a 32 psi control valve to permit cooling fuel flow only when the pressure rises to 32 psi.

While fuel traverses through the first fuel path as described above, some fuel molecules divert to parallel fuel passage 120. Parallel fuel passage 120 can fluidically couple to the first fuel path via transfer passage 104. Cooling fuel travels down parallel fuel passage 120 and enters annular drain groove 110 where it mixes with leakage fuel, having the effect of cooling the leakage fuel (described above). The fuel mixture then exits annular drain groove 110 via drain passage 109, where it flows to low pressure drain. In exemplary embodiments, fuel travels through drain passage 109 to a fuel storage vessel (not shown). In an exemplary embodiment, drain passage 109 is fluidically coupled to the first fuel path via the fuel storage vessel.

As with barrel 100, some fuel molecules from the series fuel flow, flowing through connector passage 108 to annular cooling ring 201, divert to terminal parallel fuel passage 220. Terminal parallel fuel passage 220 can fluidically couple the first fuel path via transfer passage 204. Cooling fuel travels down terminal parallel fuel passage 220 and enters annular drain groove 210 where it mixes with leakage fuel, having the effect of cooling the leakage fuel (described above). The fuel mixture then exits annular drain groove 210 via terminal drain passage 209, where it flows to low pressure drain. In exemplary embodiments, fuel travels through drain passage 209 to a fuel storage vessel (not shown). An exemplary embodiment provides for drain passage 209 to fluidically couple with the first fuel path via the fuel storage vessel. In exemplary embodiments, fuel travels through drain passage 209 to join fuel from drain passage 109, thereby forming a drain path parallel to the first fuel path. Operation of reciprocating plungers 125, 225 forming pumping chambers 106, 206 and sealing with seals 130, 230 with seal supports 133, 233 is as described above and will be omitted here for clarity and conciseness.

While the present invention has been particularly shown and described with reference to certain exemplary embodiments thereof, it will be understood by those of ordinary skill in the art that various changes in form and detail may be made therein without departing from the spirit and scope of the present invention as defined by the appended claims. For example, embodiments have been described in application of a pressurized fuel pump but are also capable of being employed in hydraulic motors receiving energy from a pressurized motive fluid.

What is claimed is:

1. A high pressure fuel pump with parallel cooling fuel flow, comprising:

a fuel pump barrel including a bore having first and second ends;

a fuel supply;

a first fuel path including a supply passage fluidically connected to said fuel supply, an annular cooling ring formed in an outer surface of said barrel facing away from said bore to receive fuel from said supply passage, and an exit passage to direct fuel from said annular cooling ring; and a second fuel path including an annular drain groove formed in said fuel pump barrel and encircling said bore, said second fuel path further including a parallel fuel passage formed in said barrel and fluidically connected to said first fuel path and said annular drain groove to deliver fuel from said first fuel path to said annular drain groove, said second fuel path further including a drain passage formed in said barrel and fluidically connected to said annular drain groove to direct fuel flow from said annular drain groove, said second fuel path forming a fuel flow parallel to fuel flow in said first fuel path.

2. The high pressure fuel pump of claim 1, wherein said parallel fuel passage is fluidically coupled to said first fuel path at said supply fuel passage.

3. The high pressure fuel pump of claim 1, wherein said parallel fuel passage is fluidically coupled to said first fuel path at said annular cooling ring.

4. The high pressure fuel pump of claim 1, wherein said parallel fuel passage is fluidically coupled to said first fuel path via a transfer passage.

5. The high pressure fuel pump of claim 1, wherein said fuel supply comprises a low pressure fuel source.

6. The high pressure fuel pump of claim 5, wherein said low pressure fuel source comprises a fuel gear pump.

7. The high pressure fuel pump of claim 1, wherein said exit passage is fluidically connected to a fuel storage vessel.

8. The high pressure fuel pump of claim 1, wherein said drain passage is fluidically connected to a fuel storage vessel via a terminal parallel fuel circuit.

9. The high pressure fuel pump of claim 1, wherein said first fuel path is fluidically coupled to a terminal series fuel circuit terminating at a fuel storage vessel, said drain passage being fluidically coupled to said first fuel path via said storage vessel.

10. The high pressure fuel pump of claim 1, wherein said exit passage is fluidically connected to an annular cooling ring of a subsequent fuel pump barrel via a connector passage.

11. The high pressure fuel pump of claim 1, further comprising:

an annular seal abutting said drain groove and located substantially at the second end of said bore; and a seal support configured to retain said seal in position to abut said drain groove, wherein said drain groove and said seal are positioned immediately adjacent one another so that the seal forms a lower wall of the drain groove.

12. The high pressure fuel pump of claim 11, wherein said drain groove is substantially at drain pressure.

13. The high pressure fuel pump of claim 11, wherein said seal support comprises an annular structure having an inner diameter different from that of the bore.

14. The high pressure fuel pump of claim 1, wherein a control valve is fluidically coupled to said first fuel path to temporarily block cooling fuel flow during engine cranking.

15. A method of providing parallel cooling flow within a high pressure fuel pump, the method comprising:

providing a first fuel path including a supply passage, a first intermediate passage formed in an outer surface of a fuel pump barrel adjacent a first end of a bore formed within said fuel pump barrel facing away from said bore, and an exit passage, wherein said supply passage, first intermediate passage, and exit passage are fluidically connected;

providing a second fuel path including a parallel passage formed in said fuel pump barrel, a second intermediate passage extending through said fuel pump barrel adjacent a second end of said bore, and a drain passage formed in said fuel pump barrel, wherein said parallel passage, second intermediate passage, and drain passage are fluidically connected, and supplying cooling fuel to said first and second fuel path, wherein said first and second fuel paths originate from a single supply and terminate to a common drain, thereby forming a parallel cooling fuel flow.

16. The method of claim 15, wherein said first intermediate passage comprises an annular cooling ring.

17. The method of claim 15, wherein said second intermediate passage comprises a drain groove.

18. The method of claim 15, wherein said second fuel path is fluidically connected to said first fuel path via a transfer passage.

19. The method of claim 15, wherein said second fuel path is fluidically connected to said first fuel path via a fuel storage vessel.

* * * * *